United States Patent [19]

Teske

[11] Patent Number: 4,705,443

[45] Date of Patent: Nov. 10, 1987

[54] APPARATUS FOR STOKING A COMBUSTOR

[76] Inventor: Lothar Teske, Hegelstr. 15, D-5000 Köln, Fed. Rep. of Germany

[21] Appl. No.: 883,997

[22] Filed: Jul. 10, 1986

[51] Int. Cl.[4] ..... B65G 65/42

[52] U.S. Cl. ..... 414/173; 110/101 R; 110/267; 198/370; 198/544; 198/954; 414/196; 414/197; 414/327; 432/239

[58] Field of Search ..... 414/173, 196, 197, 326, 414/327; 198/370, 537, 543, 544, 954; 432/87, 239; 110/101, 267

[56] References Cited

FOREIGN PATENT DOCUMENTS 2801301 7/1979 Fed. Rep. of Germany ..... 110/101

*Primary Examiner*—Robert J. Spar
*Assistant Examiner*—Stuart J. Millman
*Attorney, Agent, or Firm*—Karl F. Ross; Herbert Dubno

[57] ABSTRACT

An apparatus for feeding a combustor with viscous bulk material, particularly coal slurry, comprises two silos which are associated with at least one conveyor system, for transporting the bulk material from the silos to a plurality of fuel-feeders in the combustor. Advantageously, two conveyor systems are linked with each other so that bulk material can be distributed uniformly either from both silos or from one of the silos to all the fuel-feeders of the combustor.

12 Claims, 5 Drawing Figures

APPARATUS FOR STOKING A COMBUSTOR

FIELD OF THE INVENTION

My present invention relates to a stoking apparatus and, more particularly, to an apparatus for feeding a combustor with viscous but flowable bulk material especially coal sludge, slurry or the like.

BACKGROUND OF THE INVENTION

In one apparatus for loading a combustor (no literature being known thereon) two silos are provided side by side which are associated with at least one continuous conveyor, particularly a trough flight conveyor, which can transport the material from the silos.

The continuous conveyor has two outlet openings, each leading to a fuel-inlet station of the combustor spaced one after the other in the feed direction of the bulk material and the fuel-inlet stations open into the combustor so that the bulk material fed through the fuel-feeding stations is distributed nearly uniformly over the entire perimeter combustor when bulk material is being fed from both silos.

This apparatus has the disadvantage that on failure of one of the aforementioned bulk material conveyor systems for the combustor, working effectively independently of the other bulk material is still fed by two of the fuel-feeding stations but an unequal distribution of the bulk material combustor and thus a nonuniform combustion occurs which leads necessarily to trouble in the combustion plant.

OBJECTS OF THE INVENTION

It is an object of my invention to provide an improved apparatus for feeding a combustor, particularly with bulk material such as coal mud or sludge, which obviates the abovementioned drawback.

It is a further object of my invention to provide an improved apparatus for feeding bulk material to a combustor having two conveyor systems in which, when one of the conveyor systems fails, a uniform distribution of bulk material in the combustor nevertheless can occur.

SUMMARY OF THE INVENTION

These objects and others which will be made more apparent hereinafter are attained in an apparatus for feeding a combustor with bulk material comprising two silos or hoppers provided side by side which are associated with at least one continuous conveyor, in particular a trough flight conveyor, which can transport the bulk material from the silos. The continuous conveyor has two outlet openings leading to each fuel-feeder of the combustor spaced one after the other in the feed direction of the bulk material and the fuel-feeders open into the combustor so that the bulk material fed through the fuel-feeders is distributed nearly uniformly over the entire combustor when bulk material is being fed from both of the silos or storage bins or hoppers.

According to my invention the apparatus for loading a combustor has two conveyor systems and the first continuous conveyor of each conveyor system is followed in the feed direction of the bulk material by a second continuous conveyor, the outlet openings of both first continuous conveyors are alternately closable, the outlet openings of both first continuous conveyors open into respective inlet opening of both second continuous conveyor, the second continuous conveyors are formed to feed bulk material into a common intermediate silo and from that intermediate silo to a third continuous conveyor, the intermediate silo has at least two intermediate silo outlet ducts each leading to one of the fuel-feeders of the combustor, and the third continuous conveyors lead to at least two additional fuel-feeders of the combustor feedable with bulk material from the third continuous conveyors.

Thus it is now possible either to feed bulk material by both feed systems jointly to all the fuel-feeders of the combustor, or to feed bulk material from only one of the silos of the feed systems to all the fuel-feeders of the combustor. It is particularly advantageous when the fuel-feeders of the combustor are arranged on two opposing sides of the combustor or combustion plant (e.g. a boiler) facing each other. In this case and when using only linear continuous conveyors it is necessary, when each of the third conveyors is followed by a fourth continuous conveyor, to provide two outlet openings in the fourth conveyor spaced from each other in the feed direction which are so arranged with respect to each other that the two outlet openings of these two fourth conveyors lead pairwise to common fuel-feeders of the combustor in order to be able to conduct the bulk material flow to the latter from either one side of the combustor or the other side.

In a particularly good form of my invention the fourth continuous conveyors are positioned with their longitudinal directions parallel to each other.

In a simple and reliable structure for the second continuous conveyor the second continuous conveyor is a trough flight conveyor having a table positioned between the upper and lower stretches of the conveyor chain under the inlet opening, from which the upper stretches feeds the bulk material to the approximately centrally located intermediate silo and the lower stretches of the conveyor chain transports the bulk material from the intermediate silo to the third continuous conveyor found following the intermediate silo in the direction of movement of the lower stretch.

In order to guarantee reliable transport from the silo to the fuel-feeders of the combustor, conveyors between the intermediate silo and the fuel-feeders of the combustor, particularly in the form of screw conveyors, are provided.

In a desirable form of the first conveyor both outlet openings of both first continuous conveyors are associated with a sliding cover for alternately closing either the one or the other outlet opening. Thus both outlet openings cannot unintentionally be opened or closed simultaneously.

Advantageously, the third and also the fourth continuous conveyors are trough flight conveyors, which have at least one of the outlet openings in the base of the box of the third and fourth continuous conveyors feedable by their lower chain stretch. The first continuous conveyors may be associated with at least one auxiliary continuous conveyor feeding back the bulk material fed to the second continuous conveyors to an inlet opening of the first continuous conveyors. When the bulk material is fed at a maximum flow rate from both of the silos the continuous conveyors advantageously operate at about half of maximum capacity.

BRIEF DESCRIPTION OF THE DRAWING

The above and other objects, features and advantages of my invention will become more readily apparent from the following specific description, reference being made to the accompanying highly diagrammatic drawing in which.

SPECIFIC DESCRIPTION

Figure 1:
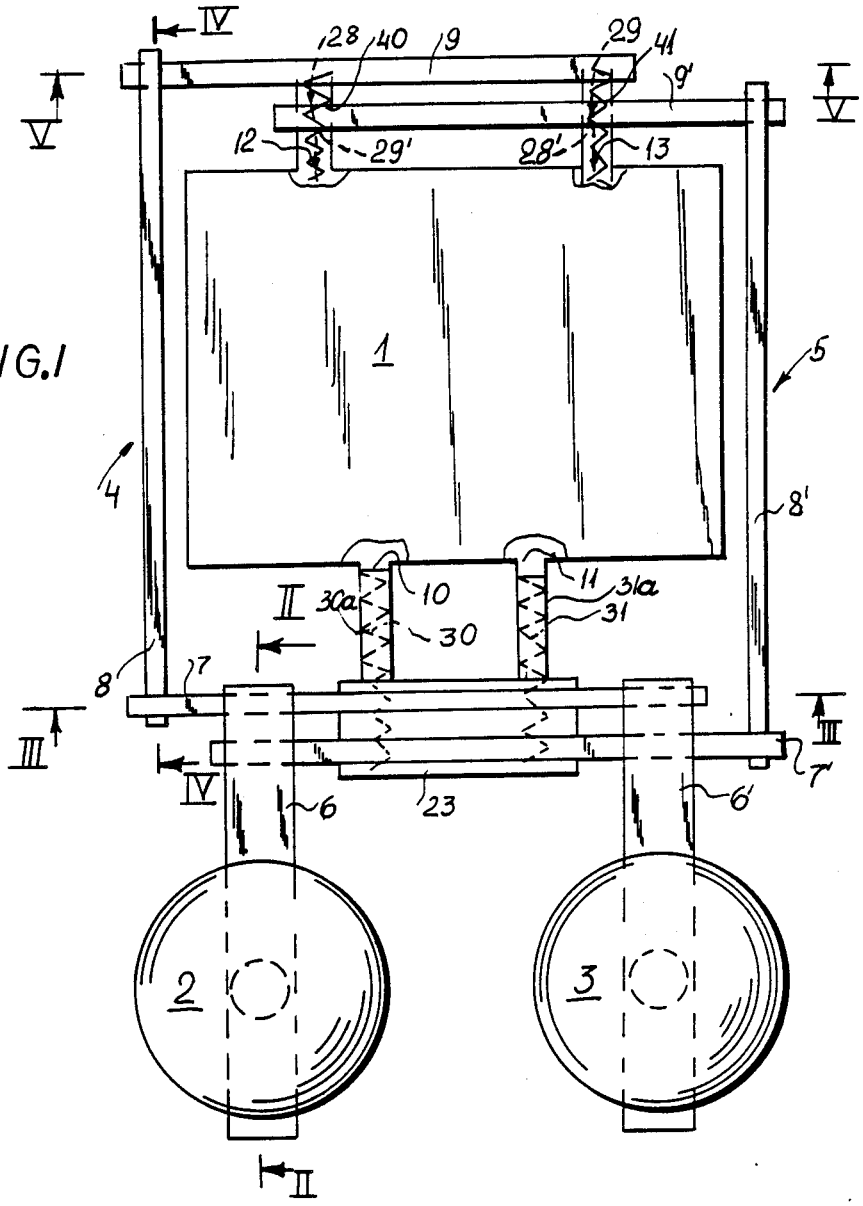
FIG. 1 is a top plan view of an apparatus for loading a combustor with viscous bulk material according to my invention.

The apparatus for feeding bulk material, particularly viscous coal slurry, to a combustor comprises two silos for storing the bulk material which are each associated with at least one (in this case two) conveyor systems 4 or 5.

Each of these conveyor systems 4, 5 comprises four continuous conveyors 6, 7, 8, 9 or 6', 7', 8', 9' which are trough flight conveyors which are arranged one after the other in the feed direction.

Two fuel-feeders 10 and 11 in the combustion chamber 1 are provided on the side of the combustion chamber 1 adjacent the silos 2 and 3.

Two additional fuel-feeders 12 and 13 are provided on the side of the combustion chamber 1 opposite the silos 2 and 3 through which the bulk material can also reach the combustion chamber 1. These stations represent pluralities of stations for distributing the fuel to the combustor generally uniformly about the interior thereof.

The continuous conveyors 6 or 6' usually have a single inlet opening 14 (FIG. 2) in the top of the box forming the respective trough and two outlet openings 16 and 17 positioned one after the other and spaoed from each other in the feed direction of the lower stretches of the conveyor chain 15. These latter openings are closable alternately by a common sliding cover 18.

The outlet opening 16 opens into a inlet opening 19 in the top of the box of the connected continuous conveyor 7. The outlet opening 17 is positioned opposite an inlet opening 19' of a continuous conveyor 7'.

In the second conveyor system 5 the individual continuous conveyors are usually formed and positioned as mirror images of those in the first conveyor system 4.

Under the inlet opening 14 table 20 is positioned between the upper and lower stretches of the conveyor chain 15, from which the bulk material is taken by the upper chain stretches and is fed to the lower chain stretches which transports the bulk material to the outlet opening 17 or 16. This has the advantage that the continuous conveyor 6 or 6' cannot be overfilled.

Figure 3:
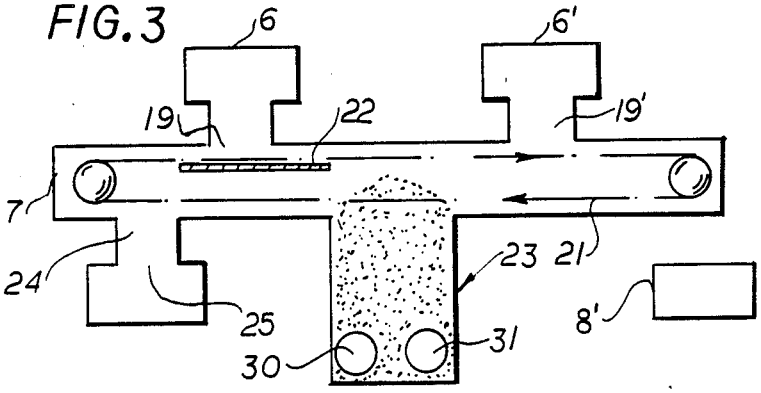
FIG. 3 is a vertical partial cross sectional view taken along the section line III—III of FIG. 1.
Figure 4:
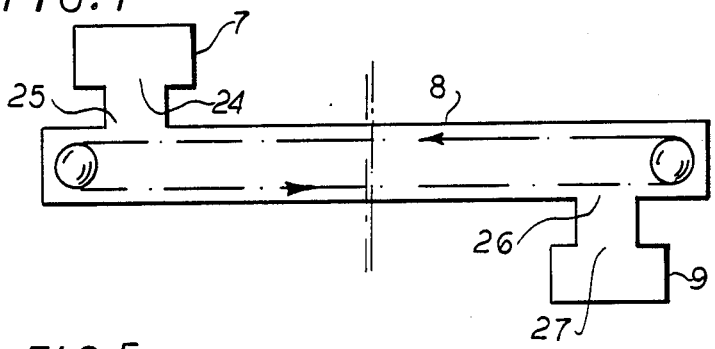
FIG. 4 is a vertical cross sectional view taken along the line IV—IV of FIG. 1.
Figure 5:
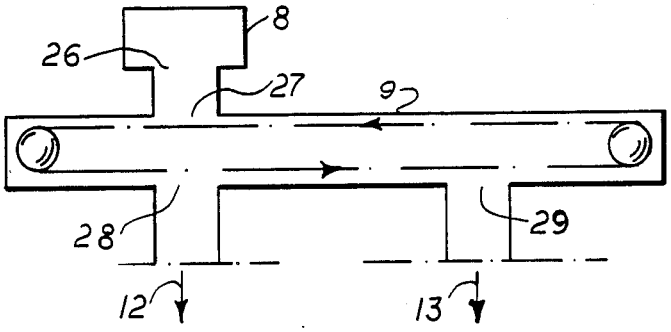
FIG. 5 is a vertical cross sectional view of the apparatus taken along the line V—V of FIG. 1.

In the continuous conveyor 7 or 7' (FIG. 3) a table 22 is rigidly held under the inlet opening 19 between both of the stretches of the conveyor chain 21. Under the continuous conveyor 7 or 7' a common intermediate silo 23 open to both continuous conveyors 7 and 7' positioned approximately in the middle of both is provided in which the upper stretches of both continuous conveyors 7 or 7' feeds the bulk material.

Should the intermediate silo 23 be filled, the lower chain stretches of the continuous conveyor 7 or 7' feeds bulk material to an outlet opening 24, which is connected with an inlet opening 25 of the continuous conveyor 8 or 8' which is found perpendicular to the conveyor 7 or 7'.

At the end of the continuous conveyor 8, 8' an outlet opening 26 is provided in the bottom of the box of the conveyor 8, 8' which is connected with the inlet opening 27 of the conveyor 9, 9' perpendicular to the conveyor 8, 8'. Finally two outlet openings 28 and 29 are provided in the bottom of the box of conveyor 9, 9' spaced from each other longitudinally, which lead to the fuel-feeders 12, 13 of the combustion chamber 1.

Further two continuous conveyors 30 and 31 formed as screw conveyors are provided for force feeding of bulk material from the intermediate silo 23 to the fuel-feeders 10, 11.

Figure 2:
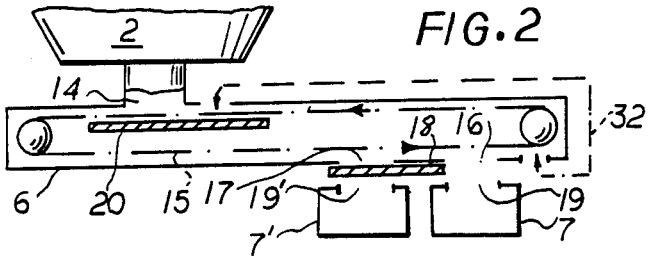
FIG. 2 is a partial vertical cross sectional view of the apparatus taken along the section line II—II of FIG. 1.

According to FIG. 2 an auxiliary continuous conveyor 32 is provided shown only schematically with dashed lines, which feeds the bulk material back to the table 20 when too much bulk material has been fed to the outlet opening 16 or 17 in order to avoid clogging the continuous conveyor 6, 6'.

When both silos 2 and 3 are filled with bulk material and both conveyor systems 4 and 5 operate correctly, bulk material is withdrawn from both silos 2 and 3 and both continuous conveyors 6 and 6' feed equal amounts of bulk material by the continuous conveyors 7 and 7' into the common intermediate silo 23, whereby it is guaranteed that the intermediate silo 23 is continuously filled with bulk material.

The bulk material from the intermediate silo 23 reaches the fuel-feeders 10 and 11 by the screw conveyors 30 and 31 mounted in the intermediate silo outlet ducts **30*a* and 31*a***.

Simultaneously bulk material from the overfilled intermediate silo 23 is fed by the lower stretches of the continuous conveyor 7 and 7' to both continuous conveyors 8 and 8' and from there to both continuous conveyors 9 and 9'.

The latter are arranged with respect to each other so that the outlet openings 28 and 29' as well as the outlet openings 29 and 28' open to the filling openings or stations 12, 13 so that all four filling openings 10 to 13 are fed equal quantities of bulk material.

When, for example, the silo 3 is emptied, the outlet opening 16 is closed by the sliding cover 18 and because of that the outlet opening 17 is forced to be open.

When the continuous conveyor 6 alone feeds at doubled rate and power, bulk material into the intermediate silo 23, the bulk material on the one hand is fed by the screw conveyors 30 and 31 to the fuel-feeders 10 and 11 and, on the other hand, by both continuous conveyors 7 and 7' to the continuous conveyors 8 and 8' and then to the continuous conveyors 9 and 9' and hence to both the other fuel-feeders 12 and 13 of the combustion chamber 1. As a result also in this case equal quantities of bulk material are fed through the various fuel-feeders into the combustor.

Under the circumstances it is advantageous to provide more than two outlet openings in the continuous conveyor 9 and 9' which open into additional fuel-feeders. Also it can be required to provide additional outlet openings opening into the continuous conveyors 8 and 8' at additional fuel-feeders of the combustor 1.

In order to guarantee a forced feeding of bulk material from the outlet openings 28 and 29' and 29 and 28' to the fuel-feeder 12, 13 additional conveyors 40 and 41 can be mounted between the outlet openings and the fuel-feeders similar to screw conveyors 30 and 31.

I claim:

1. In an apparatus for loading a combustor with viscous bulk material, particularly coal slurry, comprising two silos provided side by side and at least one continuous conveyor associated therewith which can transport said bulk material from said silos, said continuous conveyor having at least two outlet openings leading to every fuel-feeder of said combustor and spaced one after the other in the feed direction of said bulk material and said fuel-feeders opening into said combustor so that said bulk material fed through said fuel-feeders is distributed nearly uniformly throughout said combustor when said bulk material is being fed from both of said silos, the improvement wherein said apparatus has a first one of said continuous conveyors connected to one of said silos and each of said first ones of said continuous conveyors is followed in said feed direction of said bulk material by a second one of said continuous conveyors, said outlet openings of both first continuous conveyors being alternately closable, each of said outlet openings of both of said first continuous conveyors opening into an inlet opening of one of said second continuous conveyors, said second continuous conveyors being formed to feed said bulk material into a common intermediate silo and from said intermediate silo to a third one of said continuous conveyors, said intermediate silos having at least two intermediate silo outlet ducts leading to each one of said fuel-feeders of said combustor, and said third continuous conveyors leading to at least two additional ones of said fuel-feeders of said combustor feedable with said bulk material from said third continuous conveyors.

2. The improvement defined in claim 1 wherein said fuel-feeders of said combustor are mounted on two opposing sides of said combustor facing each other.

3. The improvement defined in claim 2 wherein each of said third continuous conveyors is followed by a fourth one of said continuous conveyors which has two of said outlet openings spaced from each other in said feed direction of said bulk material, said outlet openings of said fourth continuous conveyors leading pairwise to two common ones of said fuel-feeders of said combustor.

4. The improvement defined in claim 3 wherein the longitudinal directions of said fourth continuous conveyors are arranged running parallel to each other.

5. The improvement defined in claim 4 wherein each of said second continuous conveyors are formed as a trough flight conveyor having a table positioned between the upper and lower stretches of said conveyor chains thereof under an inlet opening of said second continuous conveyors, from which said upper stretches feeds said bulk material to said intermediate silo positioned approximately in the middle of said second continuous conveyors and said lower stretches transports said bulk material from said intermediate silo to said third continuous conveyor found following said intermediate silo in the motion direction of said lower stretch.

6. The improvement defined in claim 5 wherein at least one additional continuous conveyor is positioned between said intermediate silo and each of said fuel-feeders of said combustor.

7. The improvement defined in claim 6 wherein at least one of said additional continuous conveyors is a screw conveyor.

8. The improvement defined in claim 7 wherein each of said outlet openings of each of said first continuous conveyors is associated with a common sliding cover for alternately closing of the one or the other of said outlet openings.

9. The improvement defined in claim 8 wherein said third and also said fourth continuous conveyors are provided as trough flight conveyors, which have at least one of said outlet openings in the base of a trough-forming box of said third and fourth continuous conveyors feedable by the lower chain stretch of said third and fourth continuous conveyors.

10. The improvement defined in claim 9 wherein said first continuous conveyors are associated with at least one auxiliary continuous conveyor feeding back said bulk material fed to said second continuous conveyors to an inlet opening of said first continuous conveyors.

11. The improvement defined in claim 10 wherein when said bulk material is fed at a maximum flow rate from both of said silos said continuous conveyors operate with approximately half of maximum capacity.

12. An apparatus for loading bulk material, particularly coal slurry, into a combustor comprising:

two silos for said bulk material positioned side by side;

a plurality of fuel-feeders opening into said combustor where said bulk material is admitted to said combustor;

two conveyor systems each including a first continuous conveyer which receives said bulk material from one of said silos only;

two outlet openings alternatively closable by a common sliding cover in each of said first continuous conveyors;

two second continuous conveyors having two inlet openings each connected to both of said first continuous conveyors and also having a single outlet opening;

two third continuous conveyors having a single inlet opening receiving said bulk material from one of said second continuous conveyors;

two fourth continuous conveyors each connected to one of said third continuous conveyors to receive said bulk material therefrom and to at least two of said fuel-feeders to deliver said bulk material to said combustor; and a common intermediate silo connected to both of said second continuous conveyors so as to receive said bulk material therefrom, connected to at least one of said fuel-feeders by a screw conveyor so as to be able to feed said bulk material to said combustor, and from which said bulk material can also be delivered to said third continuous conveyors.

* * * * *